US006796903B1

(12) United States Patent
Bryant

(10) Patent No.: US 6,796,903 B1
(45) Date of Patent: Sep. 28, 2004

(54) GAMING MACHINE WITH INCREASED LARGE PRIZES

(75) Inventor: Natalie Bryant, Lane Cove (AU)

(73) Assignee: Aristocrat Technologies Australia Pty Ltd., Lane Cove (AU)

( * ) Notice: Subject to any disclaimer, the term of this patent is extended or adjusted under 35 U.S.C. 154(b) by 259 days.

(21) Appl. No.: 10/088,929

(22) PCT Filed: Sep. 8, 2000

(86) PCT No.: PCT/AU00/01066

§ 371 (c)(1),
(2), (4) Date: Aug. 2, 2002

(87) PCT Pub. No.: WO01/21268

PCT Pub. Date: Mar. 29, 2001

(30) Foreign Application Priority Data

Sep. 20, 1999 (AU) ..... PQ2975

(51) Int. Cl.[7] ..... A63F 9/24
(52) U.S. Cl. ..... 463/20; 463/16; 273/139
(58) Field of Search ..... 463/1, 9–13, 16–20, 463/23, 21, 25–26, 30, 36, 40–43; 273/236–237, 269, 292–293, 138.1, 138.2, 139, 143 R

(56) References Cited

U.S. PATENT DOCUMENTS 3,580,581 A * 5/1971 Raven ..... 463/22
4,448,419 A * 5/1984 Telnaes ..... 463/21
4,711,451 A * 12/1987 Pajak et al. ..... 463/22
5,630,753 A 5/1997 Fuchs
5,902,184 A 5/1999 Bennett

FOREIGN PATENT DOCUMENTS

| | | |
|---|---|---|
| AU | 17509/88 | 12/1988 |
| DE | 44 26 658 A1 | 1/1998 |
| EP | 0 368 628 A2 | 5/1990 |
| GB | 1 535 095 | 12/1978 |
| GB | 2 072 395 A | 9/1981 |

* cited by examiner

*Primary Examiner*—Mark Sager
(74) *Attorney, Agent, or Firm*—Knobbe, Martens, Olson & Bear, LLP

(57) ABSTRACT

A gaming machine including a plurality of display positions for displaying combinations of symbols of a game. A controller controls operation of the machine. The controller includes a random number selector for selecting the symbols to be displayed at each display position. The chance of a particular symbol appearing at a predetermined display position is dependent on whether or not that particular symbol has been selected to appear at least one other display position.

7 Claims, 6 Drawing Sheets

| POS: | REEL 1: | REEL 2: | REEL 3A: | REEL 3B: |
|---|---|---|---|---|
| 1 | SYMBOL A | SYMBOL A | SYMBOL A | SYMBOL A |
| 2 | KING | JACK | JACK | 10 |
| 3 | JACK | QUEEN | QUEEN | QUEEN |
| 4 | SYMBOL B | EYE | EYE | EYE |
| 5 | 10 | 10 | 10 | 10 |
| 6 | QUEEN | QUEEN | KING | QUEEN |
| 7 | SYMBOL B | SYMBOL B | SYMBOL B | SYMBOL B |
| 8 | 9 | 9 | JACK | 9 |
| 9 | KING | KING | KING | KING |
| 10 | JACK | EYE | EYE | JACK |
| 11 | QUEEN | QUEEN | QUEEN | QUEEN |
| 12 | KING | KING | KING | KING |
| 13 | SYMBOL B | SYMBOL B | SYMBOL B | SYMBOL B |
| 14 | JACK | JACK | JACK | JACK |
| 15 | 10 | KING | 10 | 10 |
| 16 | SYMBOL C | SYMBOL C | SYMBOL C | SYMBOL C |
| 17 | 9 | 9 | 9 | 9 |
| 18 | 10 | 10 | 10 | QUEEN |
| 19 | SYMBOL C | EYE | EYE | SYMBOL A |
| 20 | KING | KING | KING | JACK |
| 21 | 10 | QUEEN | QUEEN | QUEEN |
| 22 | | | SYMBOL B | SYMBOL B |
| 23 | | | JACK | JACK |
| 24 | | | 10 | |
| 25 | | | SYMBOL C | |
| 26 | | | 9 | |
| 27 | | | 10 | |
| 28 | | | EYE | |
| 29 | | | KING | |
| 30 | | | QUEEN | |
| 31 | | | | |
| 32 | | | | |
| 33 | | | | |
| 34 | | | | |
| 35 | | | | |
| 36 | | | | |

FIG. 5

| REEL 4A: | REEL 4B: | REEL 5A: | REEL 5B: | REEL 6: |
|---|---|---|---|---|
| SYMBOL A | SYMBOL A | SYMBOL A | SYMBOL A | SYMBOL A |
| JACK | JACK | JACK | JACK | KING |
| KING | KING | QUEEN | QUEEN | 10 |
| EYE | EYE | EYE | 9 | SYMBOL B |
| 9 | 9 | 10 | 10 | 9 |
| QUEEN | QUEEN | QUEEN | QUEEN | QUEEN |
| SYMBOL B | SYMBOL B | SYMBOL B | SYMBOL B | JACK |
| JACK | JACK | JACK | JACK | 9 |
| KING | QUEEN | KING | KING | KING |
| EYE | SYMBOL A | EYE | EYE | JACK |
| QUEEN | 10 | QUEEN | QUEEN | QUEEN |
| KING | KING | KING | KING | KING |
| SYMBOL B | SYMBOL B | SYMBOL B | SYMBOL B | SYMBOL B |
| 10 | JACK | JACK | JACK | JACK |
| KING | KING | 10 | 10 | 10 |
| SYMBOL C | SYMBOL C | SYMBOL C | SYMBOL C | JACK |
| QUEEN | QUEEN | 9 | 9 | 9 |
| | | 10 | 10 | 10 |
| | | EYE | SYMBOL A | SYMBOL C |
| | | KING | KING | KING |
| | | QUEEN | QUEEN | 10 |
| | | SYMBOL B | SYMBOL B | JACK |
| | | JACK | JACK | 10 |
| | | 10 | 10 | SYMBOL A |
| | | SYMBOL C | SYMBOL C | 9 |
| | | 9 | 9 | 10 |
| | | 10 | 10 | SYMBOL C |
| | | EYE | EYE | KING |
| | | KING | KING | 10 |
| | | QUEEN | QUEEN | |
| | | SYMBOL C | SYMBOL C | |
| | | 9 | 9 | |
| | | 10 | 10 | |
| | | EYE | JACK | |
| | | KING | KING | |
| | | QUEEN | QUEEN | |

FIG. 5
(CONTINUED)

GAMING MACHINE WITH INCREASED LARGE PRIZES

RELATED APPLICATION

This application claims the benefit of the Australian application PQ 2975 filed Sept. 20, 1999 and the international application PCT/AU00/01066 filed Sept. 8, 2000.

FIELD OF THE INVENTION

The present invention relates to a gaming machine of the type known as a slot machine or fruit machine. Certain types of machines have a series of rotatable reels each of which displays a series of symbols or a video simulation of such a mechanism while other types of machines are arranged to play video simulations of card games or other types of wagering games, such as bingo or keno. More particularly, the invention provides an improvement to a game played on such a machine.

BACKGROUND TO THE INVENTION

Players regularly playing gaming machines quickly tire of particular games. Therefore, it is necessary for manufacturers of these machines to develop inventive game features which add interest to the games provided on such machines in order to keep the players entertained and willing to continue to play the games.

Gaming machines of the type described are particularly well known nationally and internationally. Substantial amounts of money are wagered on these machines. In Australia, in the state of New South Wales and other states, there is a growing tendency to legalize the use of gaming machines by licensing operators with resulting revenue gains being achieved through license fees and taxation of moneys invested. The licensed operation of gaming machines is the subject of state legislation and regulation. Amongst the items regulated is the maximum percentage payout for a gaming machine. For example, a minimum of 85% of moneys invested must be returned as winnings, and manufacturers of gaming machines must therefore design their machines around these regulatory controls.

With the growth that has occurred in the gaming machine market, there is intense competition between manufacturers to supply the various existing and new venues. When selecting a supplier of gaming machines the operator of a venue must pay close attention to the popularity of various games with their patrons. Therefore, gaming machine manufacturers are keen to devise games which are popular with players as a mechanism for improving sales and for maintaining player interest. In this regard, various strategies have been tried in the past to make games more enticing to players including an increase in the number of physical reels or video simulations of such reels. It has become almost standard practice for a gaming machine to have five spinning reels or video simulations thereof.

Players using these machines have become used to these types of games and have come to expect certain things from the games. For example, players expect that every standard symbol on each reel will pay a prize for combinations of three or more of that symbol, usually on a pay line. Also, players expect not to have to play too long without being rewarded, whether by means of a large or small amount. Further, players expect that a five of a kind win is quite achievable.

Current methods employed in game design make it extremely difficult to develop games having more than five reels (a reference to "reel" is to be understood as including a video simulation of such a reel) and still maintain the expectation of players without altering the maximum percentage payout for the machine.

For reel strips of a fixed length, a player is much less likely to get a six of a kind combination on a six reel game than a five of a kind combination on a five reel game. As a result, a six reel, six of a kind win is less achievable than a five of a kind win for a five reel game.

Should the frequency of six of a kind wins be increased by manipulating the length of the reel strips and/or reducing the prizes, the frequency of three, four and five of a kind wins would be increased proportionally. This would have the result of increasing the overall theoretical percentage payout of the machine leading to losses for the venue. Removing the three of a kind win is also not an acceptable solution as players have built up an expectation of receiving a win for such a combination.

SUMMARY OF THE INVENTION

According to the invention, there is provided a gaming machine which includes:

- a display means including a plurality of display positions for displaying combinations of symbols; and
- a control means for controlling operation of the machine, the control means including a random number selection means for selecting the symbols to be displayed at each display position, the chance of a particular symbol being selected by the control means, independently of a player of the game, to appear at a predetermined display position being dependent on whether or not that particular symbol has been selected by the control means to appear at at least one other display position.

The invention has particular application in gaming machines having video simulations of spinning reels. For ease of explanation, the invention will be described with reference to that application but those skilled in the art will appreciate that the invention could be equally applicable to other types of gaming machines such as those which use simulations of playing cards or balls.

Further, for ease of explanation, the gaming machine will be described with reference to a six reel display. Once again, it will be appreciated that any number of reels could be employed in the display of the gaming machine. These reels are referred to below as the first, second, third, fourth, fifth and sixth reels. The particular symbol may be a special symbol, a substitute symbol a wild card-like symbol or some other special symbol such as a "scatter" symbol, a feature trigger symbol, a "top award" symbol, or the like. Although the invention is applicable with any chosen symbol, for ease of explanation the operation of the system will be described with reference to a substitute symbol.

The random number selection means may map a number to each position on each reel such that the symbols that appear in said predetermined display position are those that appear on the reels in the positions corresponding to the random numbers. The substitute symbol may thus have random numbers associated with the positions in which it appears on the reels.

A random number selected may be dependent on the number of symbols that can possibly appear in said predetermined display position, the control means being operable to change a set of possible outcomes of the symbol to be displayed at further, predetermined display positions dependent upon the position already selected to be displayed at said at least one other display position. Where the game is a spinning reel game, the random number selected may thus be dependent on the length of the reels and the control means may be operable to change the set of possible outcomes of one or more further reels dependent upon the symbol already selected for at least one other reel. In so doing, the probability of the substitute symbol appearing at the required display position on certain of the reels is dependent upon whether or not that substitute symbol has already been selected to appear at the display position of one or more of the other reels.

In particular, the invention is intended to increase the possibility of obtaining four of a kind of the substitute symbol which appears only on reels two, three, four and five of a six reel game and, in so doing, increasing the possibility of five or six of a kind wins of the substitute symbols in combination with other symbols on reels one and/or six. This may be achieved by decreasing the number of symbols on reels two, three, four and five to increase the frequency of four substitute symbols. However, this would then also increase the frequency of two and three substitute symbols. By means of the use of the re-mapping or re-selection process associated with the reels carrying the substitute symbols, the frequency of five and/or six of a kind wins are increased without proportionally increasing the frequency of two or three of a kind wins.

Thus, once a position has been chosen for the second reel via the random number selection means of the control means, the position may be evaluated to determine whether or not the substitute symbol will appear within the display positions of the second reel. If so, the game is played normally, without any further re-selection or re-mapping occurring. If, however, the substitute symbol is not to appear within the display positions of the second reel, re-mapping or re-selection occurs in respect of reels three, four and five to decrease the probability of occurrence of the substitute symbol within the display positions of the respective reels.

In another embodiment of the invention, the random number selection means may be governed by two sets of possible outcomes associated with each display position for further display positions, the sets of possible outcomes to be used for said further display positions being dependent oil the symbol already selected to be displayed at said at least one other display position. Once again, in the case where the game is a spinning reel game, the sets of possible outcomes for said further display positions may be reel strips of differing lengths for each of said further display positions.

BRIEF DESCRIPTION OF THE DRAWINGS

The invention is now described by way of example with reference to the accompanying diagrammatic drawings in which:

FIG. 5 shows a schematic representation of sets of reel strips for the embodiment of FIG. 4.

DETAILED DESCRIPTION OF THE DRAWINGS

Figure 1:
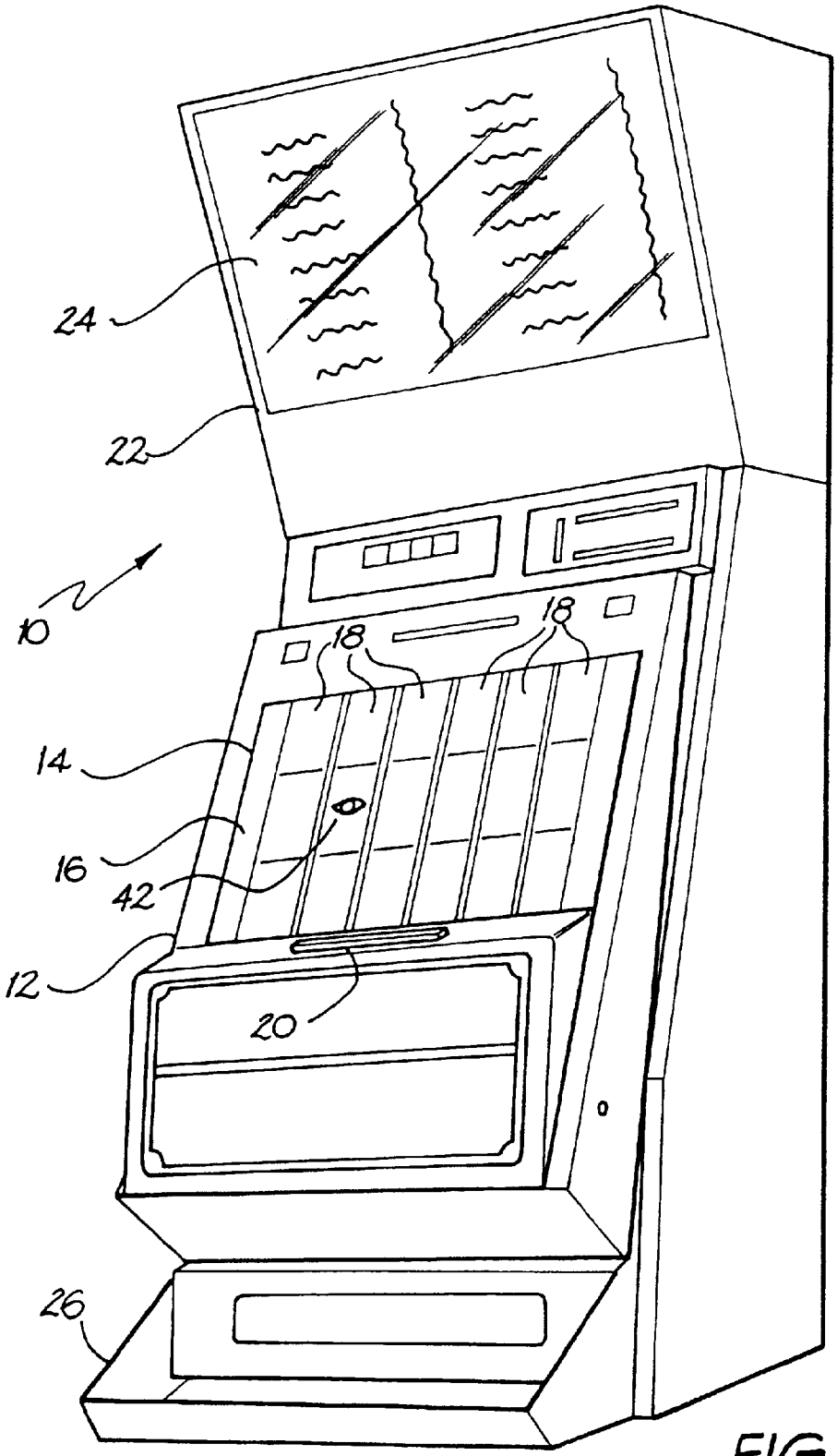
FIG. 1 shows a three dimensional view of a gaming machine, in accordance with the invention.

In FIG. 1, reference numeral 10 generally designates a gaming machine including a game, in accordance with the invention. The machine 10 includes a console 12 having a video display unit 14. The video display unit 14 includes a screen 16. Six reels 18 are simulated on the screen 16.

An actuator in the form of an operating button 20 is provided on the console 12 for causing a spinning simulation of the reels or reel strips 18 to occur when the game is played.

The machine 10 includes a top box 22 on which a paytable 24 is mounted. Further, in accordance with conventional practice, a coin tray 26 is mounted beneath the console 12 for cash payouts from the machine 10.

Figure 2:
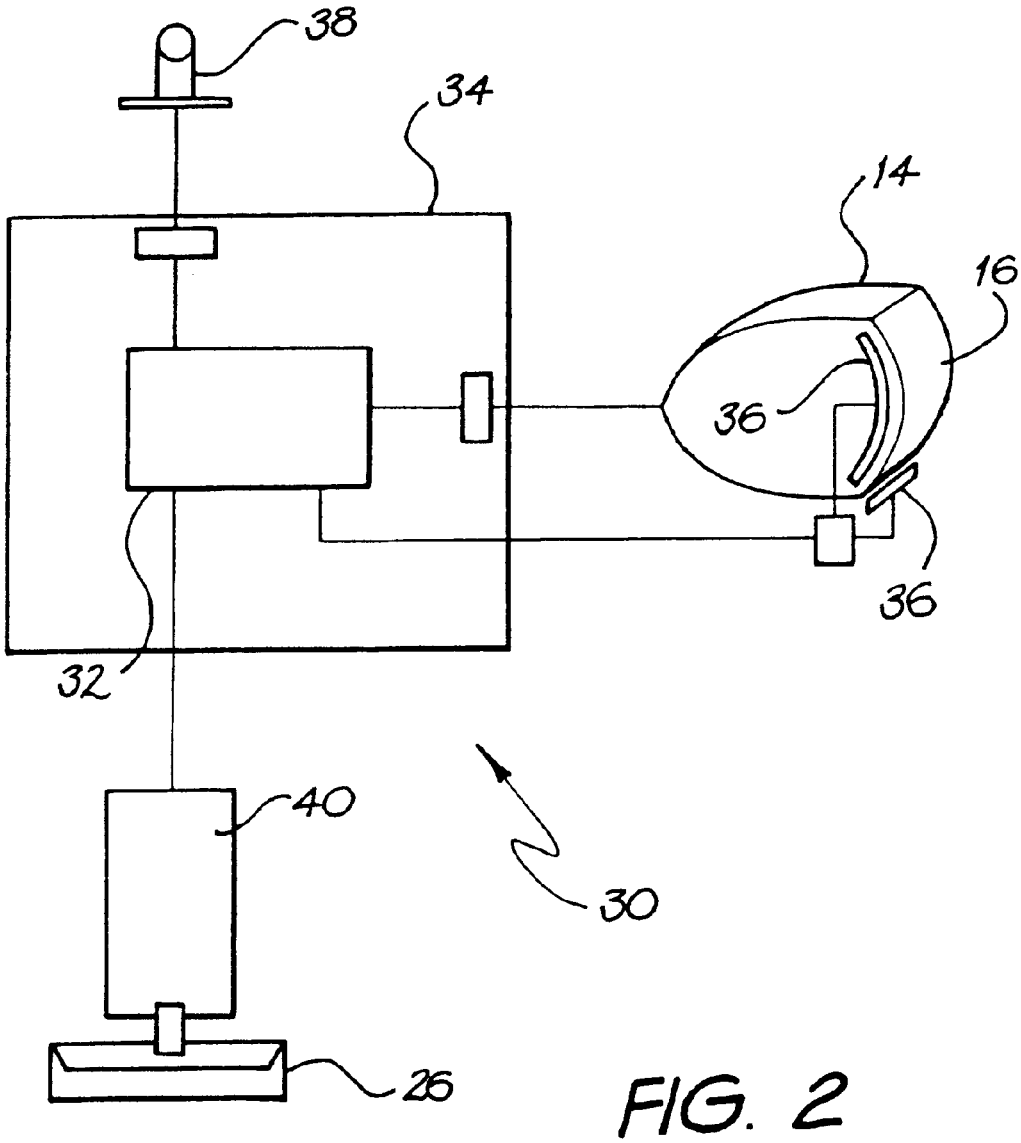
FIG. 2 shows a block diagram of a control circuit of the gaming machine.

As shown in FIG. 2 of the drawings, a control system 30 is illustrated. A program which implements the game and user interface is run on a processor 32 of the control system 30, as illustrated in FIG. 2 of the drawings. The processor 32 forms part of a controller 34 which drives the screen 16 of the video display unit 14 and which receives input signals from sensors 36. The sensors 36 may include touch sensors 36 mounted in the screen 16. However, the sensors 36 cooperate with the actuator 20 for causing the reels 18 to "spin". It will be appreciated that, instead of the actuator 20 being in the form of a button, it could be in the form of a pull handle arranged on a side of the console 12 of the machine 10.

The controller 34 also receives input pulses from a mechanism 38 indicating that a player has provided sufficient credit to begin playing. The mechanism 38 may be a coin input chute, a bill collector, a credit card reader, or another type of validation device. Finally, the controller 34 also drives a payout mechanism 40 which, for example, may be a coin output for feeding coin to the coin tray 26.

As indicated above, the machine 10 is a six reel machine. For reels or reel strips of a fixed length, a player is much less likely to get a six of a kind combination on a six reel machine than they would be to get a five of a kind combination on a five reel machine. If the odds of getting a six of a kind combination are too high, this will discourage players from playing the game. However, if the frequency of a six of a kind win is increased by manipulating the reel strips and/or reducing the prizes, the frequency of three, four and five of a kind wins will be increased proportionally resulting in an inadequate return to a gaming venue in which the machine is played.

One way of increasing the return to the venue would be to remove the three of a kind wins but this would not be an acceptable solution as players have built up an expectation that such a combination of symbols will pay a prize.

To increase the frequency of six of a kind wins without increasing the frequency of two, three or four of a kind wins proportionally, re-mapping or re-selection is carried out in respect of a substitute symbol, designated as an "eye" 42 (FIG. 1) on reels two, three, four and five of the reels 18 of the machine 10 to increase the occurrence of six of a kind payouts without increasing the occurrence of two and three of a kind outcomes. In order to do so, re-selection of certain reel positions is carried out as will now be described with reference to the flow chart illustrated in FIG. 3 of the drawings. The substitute symbol is used as a wild card-like symbol so that it may substitute as other symbols to make up winning combinations.

In a conventional game, the symbols that will apply to each position on the reel strips are predetermined. Hence, each reel strip has a predetermined length. A random number selection process occurs to determine the position at which the reel will stop "spinning". The game, in accordance with the invention, involves changing the set of possible outcomes of one or more of the reels depending upon the stopping position already selected for one or more other reels. In this way, the probability of getting the substitute symbol on certain reels 18 is dependent on whether that symbol has already been selected to appear on one or more other reels 18. In other words, the probability of the "eye" symbol 42 appearing at a display position in respect of reels three, four or five is dependent on whether or not that symbol appeared at a display position associated with reel two of the reels 1l. Moreover, if the "eye" symbol 42 appears at the display position associated with reel two, the probability of its occurring at display positions associated with each of reels three, four and five is increased.

Figure 3:
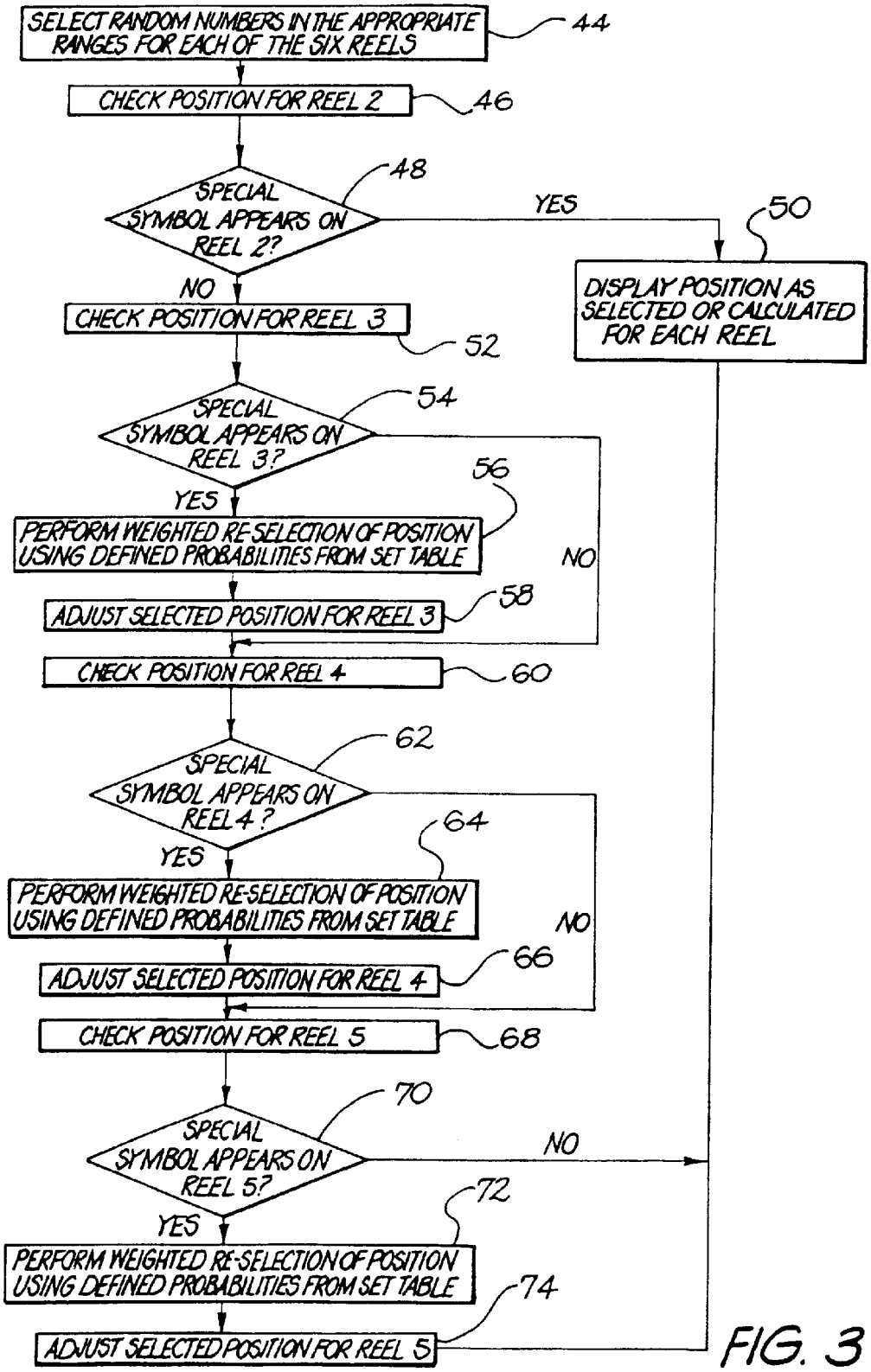
FIG. 3 shows a flow chart of part of a game to be played on the gaming machine.

Accordingly, when the actuator 20 is operated to set the reels 18 "spinning", the processor 32 selects random numbers for each of the six reels from the ranges corresponding to the length of each of the reels as shown by step 44 in FIG. 3 of the drawings. The position at which reels one, two and six will stop will correspond to the random numbers which have been selected by the processor 32 for those reels.

In respect of reel two, the position at which reel two will stop is checked at step 46. Then, at step 48, the processor determines whether or not the "eve" symbol 42 will appear in a display position. If so, the positions as selected by the processor 32 for reels three, four, and five are retained by the processor 32 and the six reels are "stopped" to display the applicable result at step 50. If a winning combination is displayed, the machine 10 pays out the applicable prize.

If, however, the "eye" symbol 42 will not appear in a display position associated With reel two, the position at which reel three will stop is checked at step 52. A selection is then made dependent on whether or not the "eye" symbol 42 will appear in a display position for the position originally selected for reel three at step 54. If the "eye" symbol 42 will appear a weighted re-selection of the position originally selected for reel three is performed using defined probabilities from a predefined table. For example, there may be a 60% probability that the position will be re-mapped to another predetermined position that is not a position including the "eve" symbol 42 in a display position and a 40% probability that the "eye" symbol 42 will remain in a display position. This step is carried out at 56. Once the determination or re-selection has been made the position at which reel three will stop is adjusted accordingly at step 58.

A similar procedure is carried out in respect of reel four at steps 60, 62, 64 and 66. Similarly, the procedure is followed in respect of reel five at steps 68, 70, 72 and 74. Once the various re-selections in respect of reels three, four and five have been made, all six of the reel positions as selected or calculated are displayed on the display 18 (step 50) and the machine 10 pays out the applicable prize, if any.

Figure 4:
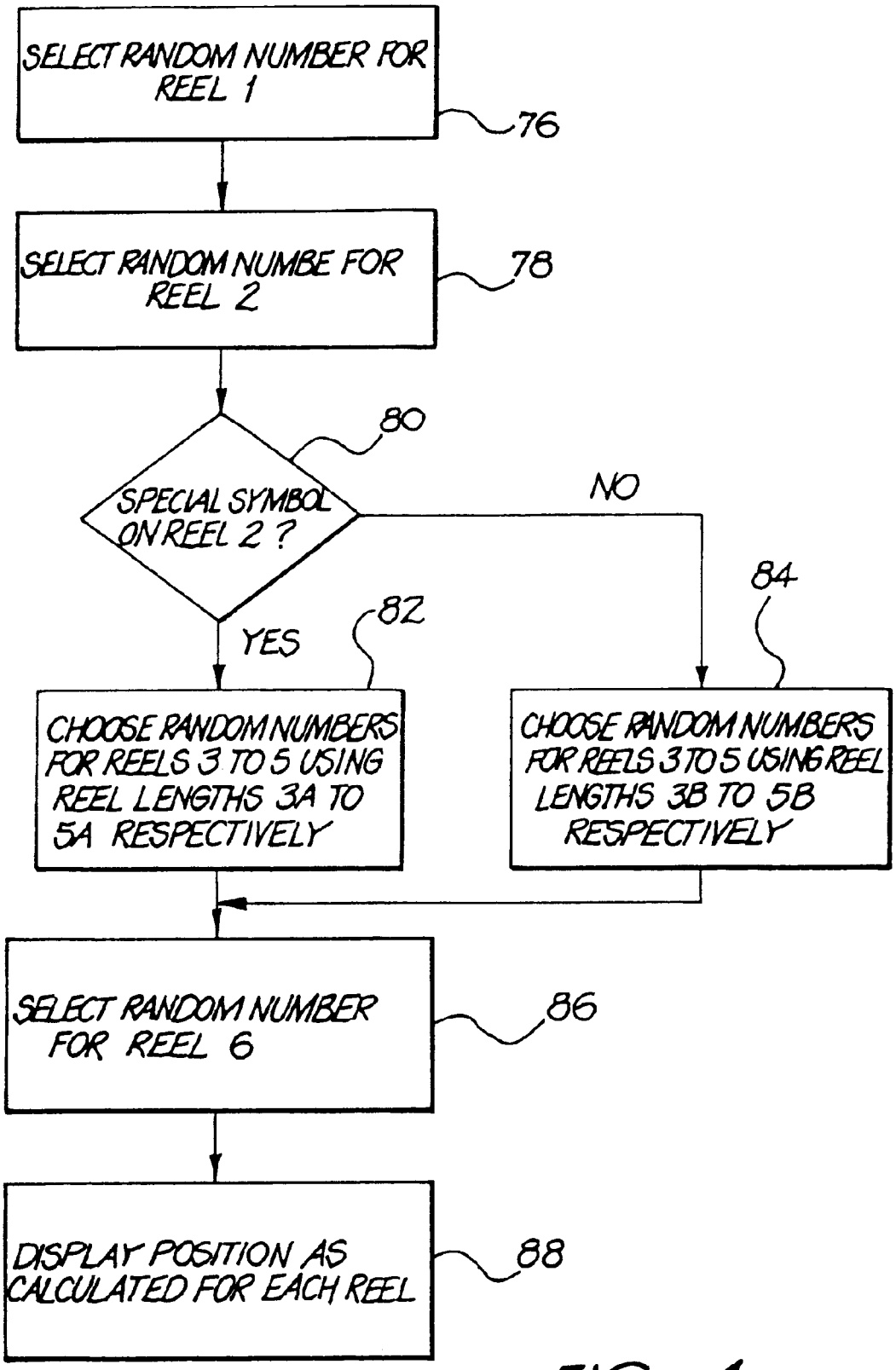
FIG. 4 shows a flow chart of another embodiment of the game.

Referring now to FIG. 4 of the drawings, another embodiment of the game is shown. In this embodiment two sets of reel strips are used for reels three to five. Either the lengths of the reel strips of each set for the same reel differ from each other or the reel strips of each set for the same reel differ in the number of "eye" symbols 42 that they have. Examples of the sets of reel strips for reels three to five are shown in FIG. 5. Depending on whether or not the "eve" symbol 42 is selected to appear on reel two, either the A or B reel strips are used. In the embodiment illustrated in FIG. 5, the A reel strips will be used only if positions three to five, nine to eleven or eighteen to twenty are selected for reel two. All other positions selected for reel two will result in the B reel strips being used for reels three to five.

Referring again to FIG. 4, at step 76, a random number in the range one to the length of reel one is selected for the first reel to be the position at which the first reel will stop. At step 78, a random number in the range one to the length of the reel two is selected to be the position at which the second reel will stop. At step 80, a selection is made depending on whether or not the "eye" symbol 42 appears in a display position in respect of reel two. If so, random numbers from the ranges of one to the length of reel 3A, one to the length of reel 4A and one to the length of reel 5A are selected for the positions at which reels three, four and five will stop respectively, as illustrated at step 82. If no "eye" symbol 42 appears in a display position in respect of reel two, random numbers from the ranges one to the length of reel 3B, one to the length of reel 4B and one to the length of reel 5B are selected to be the positions at which reels three, four, and five, respectively, will stop as illustrated at step 84. Finally, a random number in the range one to the length of reel six is chosen to be the position at which reel six will stop as illustrated at step 86 in the flow chart.

The positions as calculated for each reel are then displayed at step 88. If a winning combination is displayed, the machine 10 pays out the applicable prize.

It will be appreciated that, instead of reels, either of the above methods could be extended to re-select cards in a hand of a poker style game (for example when a joker is selected) or numbers/balls drawn for Keno or bingo style games (for example when a wild ball is selected). In addition, the check could be dependent on the positions chosen for more than one reel. For example, the re-selection could occur if the "eye" symbol 42 does not appear in a display position in respect of either of reels two or three.

It is preferred for players' suspense that the reel or reels 18 that determine whether re-selection will be required be the first reel or reels or the first reel or reels on which the special symbol appears. It is also preferred that the re-selection applies only to the top award symbols or substitute symbols of some sort but the re-selection could also apply to all symbols on the reels 18.

Hence, it is an advantage of the invention that a game is provided where the frequency of six of a kind wins is increased without increasing the occurrence of two or three of a kind outcomes proportionally. Also, a six reel machine is provided which, while having an increased probability of six of a kind payouts, due to shortened reel strips does not result in proportionally increased probabilities of two or three of a kind payouts.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming machine which includes:

a display including a plurality of display positions for displaying combinations of symbols of a game; and a controller for controlling operation of the machine, the controller including a random number selector for selecting the symbols to be displayed at each display position, the chance of a particular symbol being selected by the controller, independently of a player of the game, to appear at a predetermined display position being dependent on whether or not that particular symbol has been selected by the controller to appear at least one other display position.

2. The gaming machine of claim 1 in which the particular symbol is a special symbol having a pre-defined function.

3. The gaming machine of claim 1 wherein the random number selector maps a number to each symbol, including the particular symbol, which can appear in the predetermined display position.

4. The gaming machine of claim 3 in which a random number selected is dependent on the number of symbols that can possibly appear in the predetermined display position, the controller being operable to change a set of possible outcomes of the symbol to be displayed at further, predetermined display positions dependent on the symbol already selected to be displayed at the at least one other display position.

5. The gaming machine of claim 4, in which the game is a spinning reel game and the random number selected being dependent on the length of the reels and the controller being operable to change the set of possible outcomes of at least one further reels dependent upon the symbol already selected for at least one other reel.

6. The gaming machine of claim 1 in which the random number selector is governed by two sets of possible outcomes associated with each display position for further display positions, the sets of possible outcomes to be used for the further display positions being dependent on the symbol already selected to be displayed at the at least one other display position.

7. The gaming machine of claim 6 in which the game is a spinning reel game and the sets of possible outcomes for said further display positions are reels strips of differing lengths for each of said further display positions.

* * * * *

UNITED STATES PATENT AND TRADEMARK OFFICE

CERTIFICATE OF CORRECTION

PATENT NO. : 6,796,903 B1
DATED : September 28, 2004
INVENTOR(S) : Bryant

It is certified that error appears in the above-identified patent and that said Letters Patent is hereby corrected as shown below:

Title page,
Item [56], References Cited, FOREIGN PATENT DOCUMENTS, delete "1/1998" and insert -- 1/1996 --.

Column 6,
Line 65, before "least" insert -- at --.

Signed and Sealed this

Seventh Day of February, 2006

JON W. DUDAS
*Director of the United States Patent and Trademark Office*